US005723807A

United States Patent [19]

Kuhn, II

[11] Patent Number: 5,723,807

[45] Date of Patent: Mar. 3, 1998

[54] EXPANDED METAL ARMOR

[75] Inventor: James A. Kuhn, II, San Jose, Calif.

[73] Assignee: FMC Corporation, Chicago, Ill.

[21] Appl. No.: 144,772

[22] Filed: Jan. 20, 1988

Related U.S. Application Data

[63] Continuation of Ser. No. 788,610, Jun. 20, 1985, abandoned.

[51] Int. Cl.[6] ..... F41H 7/04

[52] U.S. Cl. ..... 89/36.02; 89/36.08

[58] Field of Search ..... 49/50; 52/670, 52/671, 672; 89/36.02, 36.08, 40.03; 109/49.5, 82, 83, 84, 85; 180/68.6; 428/596, 911; 105/394

[56] References Cited

U.S. PATENT DOCUMENTS

| | | | |
|---|---|---|---|
| 1,087,511 | 2/1914 | Scammell | 52/670 |
| 2,369,128 | 2/1945 | Bartsch | 428/596 |
| 2,962,107 | 11/1960 | Mihal et al. | 180/68.6 |
| 3,583,100 | 6/1971 | Catalano | 49/50 |
| 3,583,236 | 6/1971 | Schaffler | 89/36.08 |
| 4,121,666 | 10/1978 | Rozniecki | 89/36.08 |
| 4,132,271 | 1/1979 | Mikaila | 89/36.08 |
| 4,248,342 | 2/1981 | King et al. | 109/49.5 |
| 4,351,558 | 9/1982 | Mueller | 89/36.08 |
| 4,398,446 | 8/1983 | Pagano et al. | 89/36.08 |
| 4,455,801 | 6/1984 | Merritt | 109/84 |

FOREIGN PATENT DOCUMENTS

| | | | |
|---|---|---|---|
| 542351 | 1/1942 | United Kingdom | 89/36.08 |

OTHER PUBLICATIONS

Oberg et al. Machinery's Handbook, 1948, p. 1542.

Brady, George S., Materials Handbook, 1956, p. 947.

Perry et al., Chemical Engineer's Handbook, 1973, pp. 26–56.

Baumeister, Theodore, Mechanical Engineer's Handbook, 1958, pp. 6–25, 6–36.

Portion of Niles Expanded Metal—Catalog dated 1983 including pp. 2 and 4–6.

Single page, No. 0401 from unidentified publication entitled expanded metal (undated).

Single page, No. 1962 from an unidentified publication entitled Carbon Steel Ornamesh (undated).

Single page No. 1415 from an unidentified publication (undated).

*Primary Examiner*—Michael J. Carone

*Attorney, Agent, or Firm*—Michael B. K. Lee; Douglas W. Rudy

[57] ABSTRACT

A method, apparatus and article of manufacture is disclosed for using stand-up expanded metal armor members for protecting vehicles or other objects from ballistic threats. One or more spaced expanded metal member has projectile engaging faces which present sharp edges and arcuate surfaces to the small point of the projectile. When the point of the projectile engages the faces of the expanded metal members, the projectile is progressively deflected or shattered causing the wide arcuate side surface of the projectile to stop the projectile, or to pass through some or all of the members and engage the protected object with less than lethal force.

12 Claims, 5 Drawing Sheets

FIG_3
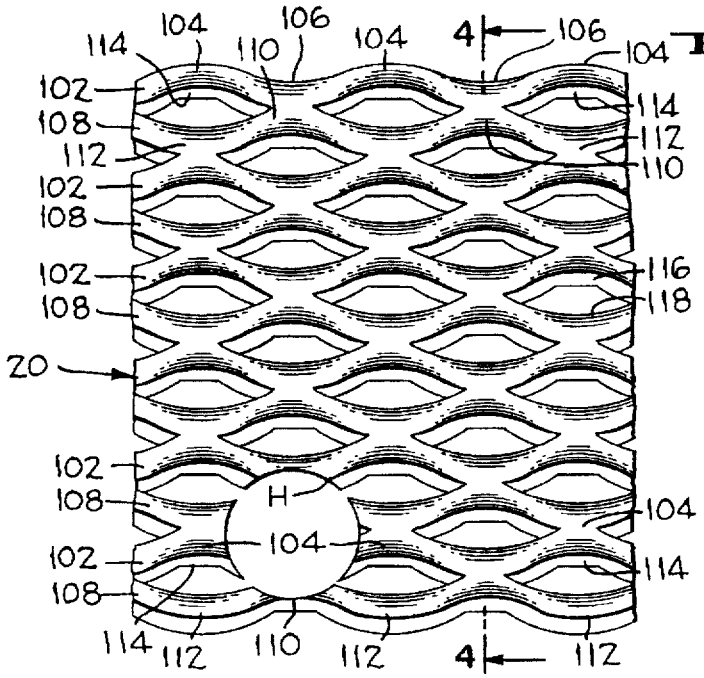
FIG_4
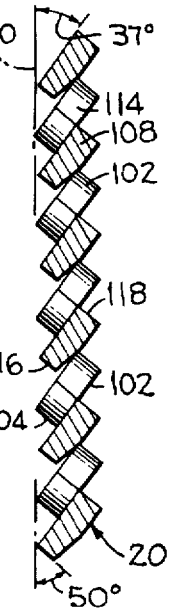
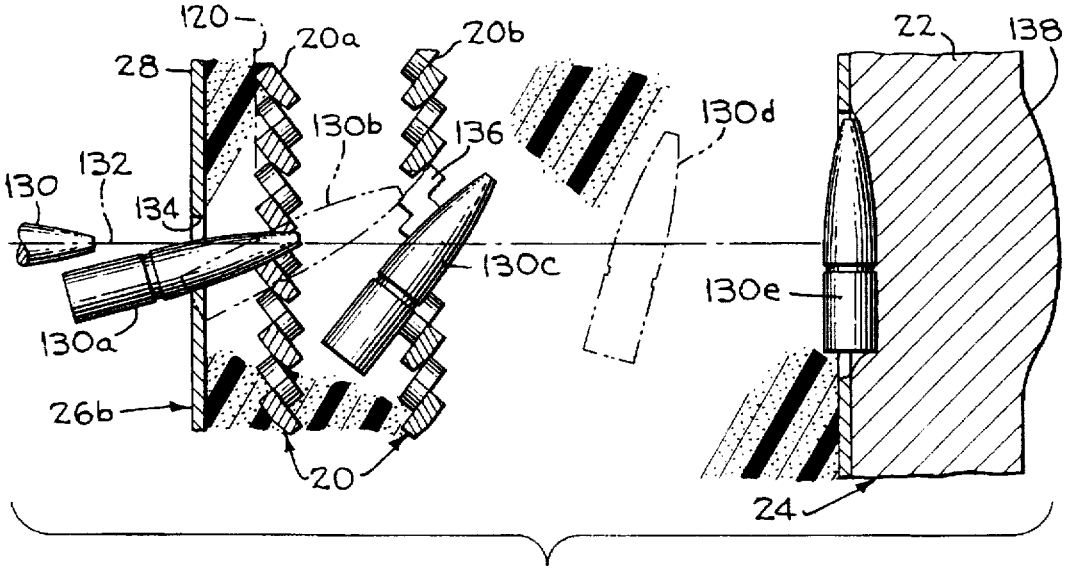
FIG_5

FIG_6

BALLISTIC TEST TABLE I - 14.5 mm

| TEST NO. | 1 | 2 | 3 | 4 | 5 | 6 | 7 | 8 | 9 |
|---|---|---|---|---|---|---|---|---|---|
| STEEL TYPE AISI | 4355 | 4355 | 4355 | 4355 | 4355 | 4140 | 4140 | 4140 | 4140 |
| STEEL THICKNESS | 1/4" | 1/4" | 1/4" | 1/4" | 1/4" | 3/16" | 3/16" | 3/16" | 3/16" |
| PROJECTILE SIZE | 14.5mm | 14.5mm | 14.5mm | 14.5mm | 14.5mm | 14.5mm | 14.5mm | 14.5mm | 14.5mm |
| VELOCITY AT 1st MEMBER FT/SEC | 3330 | 3276 | 3258 | 3255 | 3293 | 3268 | 3285 | 2864 | 2930 |
| TYPE OF PENETRATION 1st MEMBER | 14.5mm Hole | 14.5mm Hole | | | | | | | |
| HORIZONTAL | | | 1 7/8" | 1 1/2" | 1 1/2" | 9/16" | 1" | 1" | 1 1/2" |
| VERTICAL | | | 1 1/16" | 1 1/4" | 1 1/2" | 1" | 1 3/8" | 1" | 1" |
| TYPE OF PENETRATION 2nd MEMBER | | | | | | | | | |
| HORIZONTAL | 1 1/2" | 2" | 3" | Broke Out | Broke Out | 2" | 1 1/2" | 1 1/4" | 1 1/2" |
| VERTICAL | 1" | 1 1/4" | 2 3/4" | Broke Out | Broke Out | 1 7/8" | 1" | 1 7/16" | 1 9/16" |
| TYPE OF DAMAGE TO AISI 5083 AL | 1/2" Bulge | Slight Bulge Only | 1/8" Bulge Only | 1/4" Bulge Only | Small Hole | Small Hole | Small Hole | Small Hole | Small Hole |
| ROCKWELL HARDNESS | RC 54 | RC 54 | RC 54 | RC 54 | RC 54 | RC 45 | RC 45 | RC 45 | RC 45 |
| | | | | | | | | | |

FIG_7

BALLISTIC TEST TABLE II - .50 Cal.

| TEST NO. | 10 | 11 | 12 | 13 | 14 | 15 | 16 | 17 | 18 |
|---|---|---|---|---|---|---|---|---|---|
| STEEL TYPE AISI | 4355 | 4355 | 4355 | 4355 | 4355 | 4355 | 4140 | 4140 | 4140 |
| STEEL THICKNESS | 1/4" | 1/4" | 1/4" | 1/4" | 1/4" | 1/4" | 3/16" | 3/16" | 3/16" |
| PROJECTILE SIZE | .50 Cal. | .50 Cal. | .50 Cal. | .50 Cal. | .50 Cal. | .50 Cal. | .50 Cal. | .50 Cal. | .50 Cal. |
| VELOCITY AT 1st MEMBER FT/SEC | 2932 | 2981 | 3072 | 2937 | 2977 | 2943 | 2992 | 2987 | 2947 |
| TYPE OF PENETRATION 1st MEMBER | Small Hole | Small Hole | Small Hole | | Small Hole | | | | |
| HORIZONTAL | | | | 1 1/2" | | 1 1/2" | 1/2" | 1 1/2" | 3/4" |
| VERTICAL | | | | 2" | | 1 1/4" | 1/2" | 1 1/2" | 9/16" |
| TYPE OF PENETRATION 2nd MEMBER | | | | | | | | | |
| HORIZONTAL | 2 1/2" | | 2 1/2" | 2 3/4" | 2 1/2" | 4" | 1 1/8" | 1 1/2" | 1" |
| VERTICAL | 3" | | 1" | 2 1/2" | 1 1/2" | 3" | 1" | 2 1/2" | 3/4" |
| TYPE OF DAMAGE TO ALUMINUM | Surface Damage | Surface Damage | Surface Damage | 1/4" Bulge | Surface Damage | Surface Damage | Penetrated Small Hole | Bulge | Penetrated Small Hole |
| STEEL HARDNESS ROCKWELL | RC 54 | RC 54 | RC 54 | RC 54 | RC 54 | RC 54 | RC 45 | RC 45 | RC 45 |
| | | | | | | | | | |

EXPANDED METAL ARMOR

This application is a continuation of application Ser. No. 06/788,610, filed Jun. 20, 1985 now abandoned.

BACKGROUND OF THE INVENTION

1. Field of the Invention

The present invention pertains to expanded metal armor, and more particularly relates to such armor secured to objects including vehicles for protection against ballistic threats.

2. Description of the Prior Art

Armor plate has previously been formed from hardened plates that are drilled or punched to provide a plurality of holes which present a plurality of edges that are intended to deflect or tumble a projectile to reduce its lethality. However, the loss of material due to drilling or punching holes in the plates result in a considerable loss of material and require large and expensive drilling or punching machines thus making the cost of such armor plate high. Also, the thickness of the plates needed to protect the objects or vehicles are about twice the thickness of plates used to manufacture the expanded metal armor of the present invention.

SUMMARY OF THE INVENTION

In accordance with the present invention an armor member or plate, and a method and apparatus for using the same is disclosed. The armor member is in the form of regular expanded metal, also known as "stand-up" expanded metal.

If the armor is to be used on an existing armored military vehicle, one or more layers of expanded metal are preferably used. When the first layer is contacted by a projectile moving along a path substantially normal to the face of the expanded metal member or armor, the forward pointed end surface of the projectile engages only curved surfaces, flat surfaces at acute angles to the intended path of the projectile and/or sharp edges all of which deflect the projectile causing the projectile to tumble upon impact with the first or outer layer of expanded metal. This causes a larger arcuate side surface of the projectile to engage the second layer of expanded metal. However, the high velocity 14.5 mm projectile may contact the sharp edges with sufficient force to shatter or disintegrate the projectile. Contact by the larger arcuate surface of the projectile spreads the impact force over a larger area which further reduces the lethality of the projectile. The thickness of the expanded metal members is preferably such that the wide surface contact will cause the projectile to break through the second member and thereafter contact the vehicle with less than lethal force. In this way the armor of old military vehicles may be upgraded to withstand new and more powerful projectiles while minimizing the increased weight of the vehicle due to armor plating.

If the armor is to be used as the only armor for an object or vehicle to be protected, a single or a plurality of expanded metal members of sufficient thickness to deflect a particular type and size of projectile will be mounted on, or in position to protect the object or vehicle.

As used herein, the term "expanded metal member" or "expanded metal armor" is intended to cover armor members manufactured in any way having the general shape of "stand-up" expanded metal, and which presents curved surfaces, sharp edges, and flat surfaces disposed at an acute angle to the face of the armor being contacted, which surfaces and edges cooperate to deflect or tumble the projectile from its normal path of movement.

BRIEF DESCRIPTION OF THE DRAWINGS

FIG. 3 is an elevation of a fragment of expanded metal armor illustrating a mounting hole therein.

FIG. 4 is a vertical section taken along lines 4—4 of FIG. 3.

FIG. 5 is a diagrammatic operational view illustrating the manner in which the projectile is tumbled.

FIG. 6 is a table indicating data relating to tests made with 14.5 millimeter projectiles.

FIG. 7 is a table indicating data relating to tests made with 0.50 caliber projectiles.

DESCRIPTION OF THE PREFERRED EMBODIMENT

The expanded metal armor members 20 (FIGS. 1 and 2) are secured to, or about, any desired article, body or member, or portions thereof, to be ballistically protected. As illustrated herein, the expanded metal armor 20 is secured to the body 22 of a self propelled vehicle 24. The body of the illustrated vehicle is formed from armor plate aluminum which provides adequate projection from small arms fire but requires additional armor for protection against larger and higher velocity projectiles such as 0.50 caliber, 12.5 mm and larger projectiles now in common use.

Figure 1:
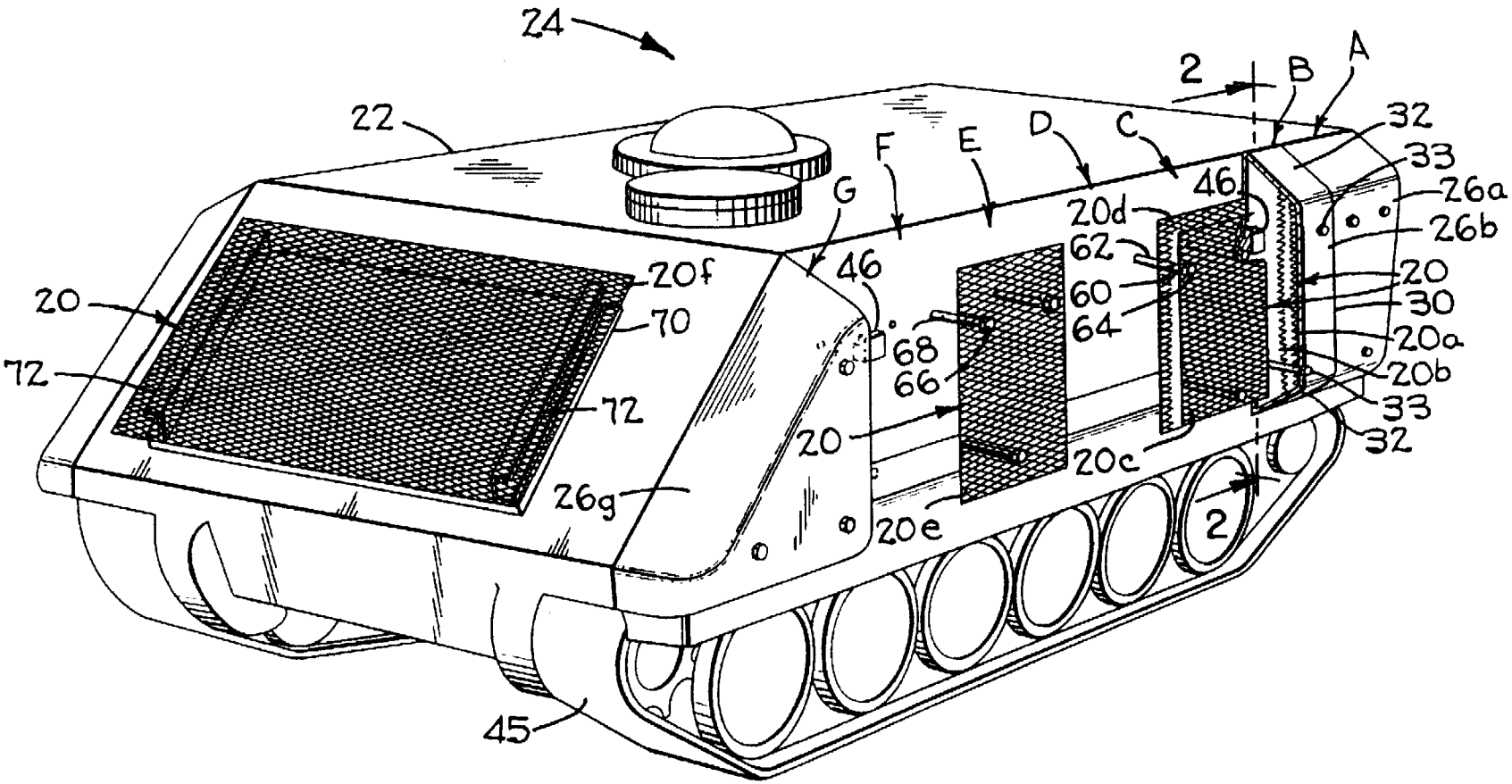
FIG. 1 is a perspective view of a military vehicle illustrating a plurality of different ways of mounting one or more expanded metal members onto the vehicle.

Several methods of mounting expanded metal armor or members on the body 22 of the vehicle are illustrated in FIG. 1. A first and preferred method is illustrated at positions A, B and G. In each of these positions, two spaced expanded metal members 20 such as members **20*a* and 20*b* at position B (FIG. 1), are mounted within housings 26*a*,26*b* and 26*g***, respectively.

Figure 2:
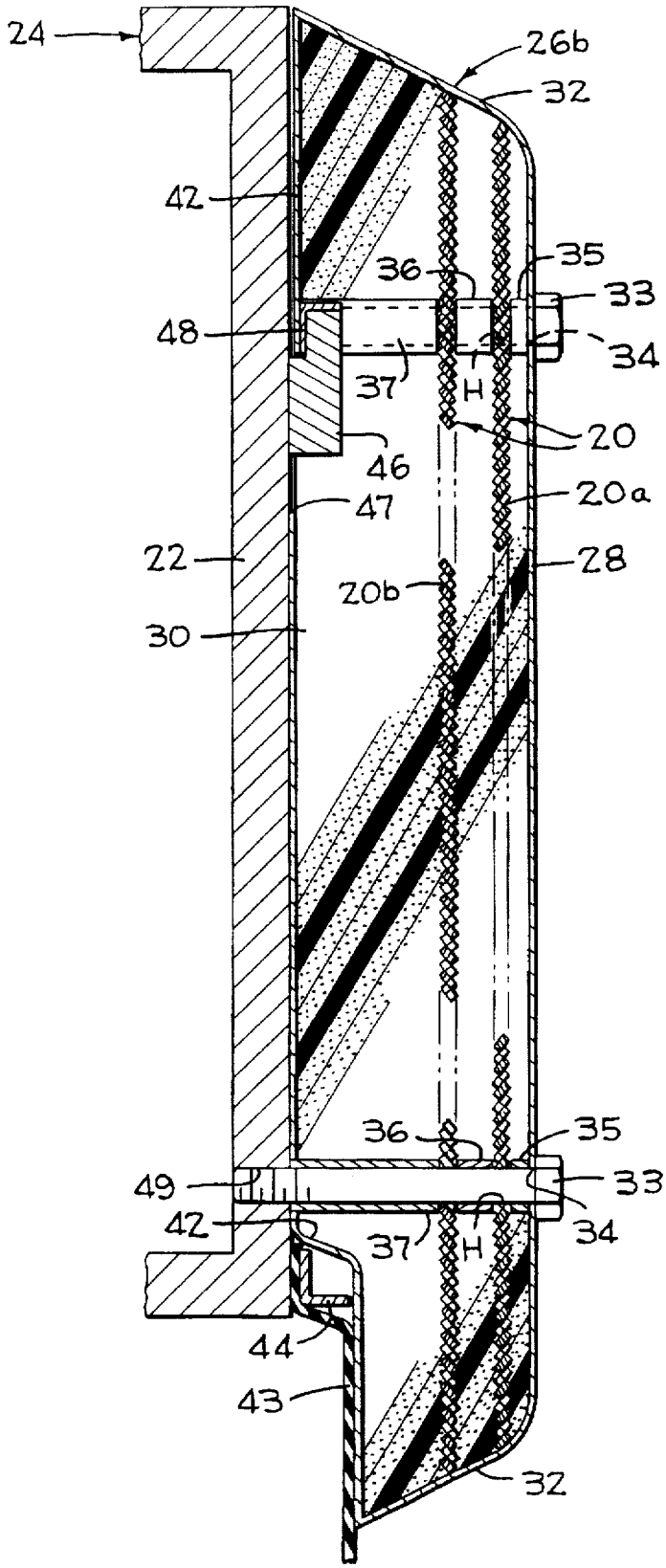
FIG. 2 is an enlarged vertical section taken along lines 2—2 of FIG. 1.

The housing **26*b* at position B (FIGS. 1 and 2) has an outer wall 28, two side walls 30, and two curved or otherwise shaped end walls 32 (FIG. 2). A plurality of cap screws 33 extend through holes 34 in the outer wall 28. Each cap screw extends through a short tubular spacer 35 that is about ½ inch long, a hole H in the outer or first expanded metal member 20*a*, a second spacer 36 that is about 1 inch long, a hole in the inner or second expanded metal member 20*b*, and a third tubular spacer 37 which is about 4 inches long. The housing 26*b* is completed by welding an inner wall 42 to the peripheries of the side walls 30 and end walls 32 and to the spacers 37. The lower portion of the inner wall 42 is curved inwardly and downwardly to overlie a skirt 43 of the vehicle 24 and an angle bracket 44, which skirt serves as a fender to enclose the upper run of the adjacent tracks 45 (FIG. 1) of the illustrated vehicle. The inner wall 42 (FIG. 2) is provided with an opening 47 to receive a mounting block 46 which is welded to the body 22 of the vehicle and is cut away to receive a leg of an angle bracket 48 that is welded to the inner wall 42 and assists in supporting the housing 26*b* and its contents on the vehicle. The cap screws 33, three being shown for each housing, are secured into tapped holes 49 in the body 22 and snugly support the housing 26*b* and its contents, which includes the expanded metal members 20*a* and 20*b*, on the body 22 of the vehicle 24**.

During the process of assembling the housing 26b, the outer wall 28 is preferably rested on a horizontal surface with the cap screws 33 projecting upwardly thus making the assembly of the several spacers, expanded metal members and inner wall 42 easy. Preferably, the housing 26b with the expanded metal members therein is filled with a foam, such as polyurethane which is blown therein through the opening 47 thus minimizing vibration and objectionable noise. The housing 26b also protects personnel from being cut by the many sharp edges included in the expanded metal members 20a,20b, and further act as flotation members if the vehicle is amphibious.

It will be noted that the housing 26a at the rear end of the vehicle 24, and the housing 26g at the front of the vehicle are shaped to receive expanded metal members that conform to the particular shapes of the vehicle which they protect.

When using two expanded metal members as discussed above for defeating 0.50 caliber or 14.5 mm projectiles, the expanded metal members will preferably be made from steel plate having a thickness of ¼ inch or 3/16 inch before expansion. These housings and their contents are light enough for one man to assemble new housing onto the vehicle or to remove damaged housings and their contents off of the vehicle.

The thickness of the expanded metal members made from ¼ inch plate is about ½ inch thick after the metal is expanded; and the members made from 3/16 inch plate expand to about ⅜ of an inch after made into expanded metal. This extra thickness of the expanded metal and the sinuous nature of the expanded metal minimizes bending that would occur in a flat plate when struck by projectile but deflects a small amount before the projectile passes therethrough (as intended when the expanded metal members are mounted on an existing armored military vehicle) thereby further reducing the velocity and lethality of the projectile.

As illustrated in FIG. 1, position C discloses a second method of mounting the expanded metal armor on the body of the vehicle 24. In this second method, two expanded metal armor members 20c,20d are separated about 1 inch from each other and about 4 inches from the body 22 by spacers 60,62 mounted on cap screws 64 which are screwed into threaded holes in the body 22 of the vehicle 24.

Position D of FIG. 1 is shown unprotected by expanded metal armor due to the small scale of FIG. 1, while position E illustrates a third method of connecting expanded metal armor 20e to the body 22 of the vehicle 24. In the third manner, the single expanded metal armor member 20e is mounted on cap screws 66 and about 4 inch long spacers 68 thereon before being screwed into tapped holes in the body 22 of the vehicle.

Position F is illustrated as being unprotected but illustrates a mounting block 46 welded to the body 22 for supporting an armor filled housing that is identical to housing 26b.

Position G illustrates a generally triangular shaped housing 26g which conforms to the shape of the forward end portion of the vehicle 24 and is supported by cap screws and a mounting block (not shown) similar to the block 46 at position B. It will also be noted that the housing 26a at station A conforms to the shape of the rear end of the vehicle.

Other portions of the vehicle 24 may be protected by one or more layers of expanded metal armor members 20. For example, the forward entry door 70 may have an expanded metal member 20f bolted or welded to mounting means such as channel members 72 that are preferably bolted to the door 70. If more protection is desired at the forward end of the vehicle, two or more layers of expanded metal members may be bolted in spaced relation to the channel member 72 to provide such additional ballistic protection as is required.

As previously indicated, the preferred method of mounting the expanded metal members 20 to the vehicle is to enclose two spaced layers of expanded metal in foam filled housings 26 and then mount the housing on the vehicle 24. When following the preferred method, it will be understood that identically sized interchangeable containers will be mounted on the vehicle at stations B and F on both sides of the vehicle thus minimizing inventory problems.

It will also be understood that if an area of the vehicle is particularly vulnerable to ballistic threats, such as a wall area adjacent an ammunition storage area or fuel tanks, this area may be protected by an additional layer, or layers, of expanded metal members.

Although the expanded metal armor has been illustrated on a military vehicle, it will be understood that any object or structure, fixed or mobile, to include military and commercial vehicles, ships and other floating or powered vehicles, aircraft to include fixed and rotary wing, remotely piloted land, air and space vehicles, or fixed equipment may be protected by the expanded metal. Furthermore, the invention is not intended to be limited to the above described method for economically upgrading the armor protection on existing objects or vehicles to resist more powerful projectiles, but may be used on new objects or vehicles for providing the desired protection while minimizing the weight of the object or vehicle due to providing armor protection for the same.

The theory of operation of the expanded metal armor will now be described having reference to FIGS. 3 and 4, which theory is supported by preliminary ballistic tests to be described hereinafter.

Each expanded metal member 20 (FIGS. 3 and 4) is formed from steel and includes a first plurality of spaced sinuous strips 102 having longitudinally spaced first high points or arcuate sections 104 and first low points or arcuate sections 106. A second plurality of sinuous strips 108 are formed between said first strips 102 and include second high points or arcuate sections 110 and second low points or arcuate sections 112. The first high sections 104 and the adjacent second low sections 112 are integral with each other; and the first low sections 106 are integral with the adjacent second high sections 110. The adjacent first and second arcuate sections of the sinuous strips 102 and 108 define openings 114 therebetween which are defined by sharp edged planar surfaces 116,118 which are preferably formed by shearing the steel into its expanded metal configuration.

As shown in FIG. 4, the illustrated expanded metal member has a planar face 120, with the planar face contacting all of the second arcuate high sections 110. However, it will be understood that the expanded metal and thus the face 120 need not be planar but may be arcuate or of any other desirable shape which conforms to the shape of different portions of the vehicle for best protecting the vehicle from the projectile.

As indicated in Ballistic Test Table I (FIG. 6) tests were made using 14.5 mm ammunition designated as Russian B-32 having a projectile weight of 990 grains. Two expanded metal members of AISI 4355 made from quarter inch plate and hardened to Rockwell 54 were used in 5 tests, while two expanded metal members of AISI 4140 made from 3/16 inch plate and hardened to Rockwell 45 were used in four additional tests. These tests indicate that both 4355 and 4140 steel defeated the lethality of the 14.5 mm since damage to the AISI 5083 aluminum was limited to only bulges in four tests and penetrated the aluminum only with a small hole in the fifth test.

When firing 14.5 mm projectiles at two layers of AISI 4140 expanded metal made from 3/16 inch plate, the damage was greater than that of AISI 4355, but were adequate since only small holes were formed in the AISI 5083 aluminum armor. None of these tests resulted in damage large enough to destroy the vehicle. Also, when firing the 14.5 mm projectiles, the high velocity and heavy weight caused several rounds to shatter or disintegrate before contacting the AISI 5083 aluminum armor.

In all of the tests the given velocity is that measured at the first layer of expanded metal, and the path of the projectile was perpendicular to the planes of the two expanded metal members and the aluminum armor, which perpendicular path is the most lethal firing direction. In all tests the first and second expanded metal members were placed one inch apart, and the second member was spaced 4 inches from the aluminum armor. It will be understood that other combinations are possible.

The type of penetration of the first and second expanded metal members was taken by measuring the maximum horizontal and vertical dimensions of holes formed in the first and second members. All tests, except tests 1 and 2 indicate that the projectile was deflected or turned upon contact with the first member, and was deflected an additional amount when contacting the second expanded metal member. For example, test No. 3 indicates that the first member deflected the projectile 1 7/8 inches horizontally and 1 1/16 inches vertically, while the second member deflected the projectile 3 inches horizontally and 2 3/4 inches vertically indicating that the arcuate side surface, not the point, of the projectile impacted in the aluminum armor plate.

The data listed in Ballistic Test Table II covers tests that were made with 0.50 caliber ammunition designated as United States AP-M2 ammunition having a projectile weight of 695 grains. The tests were conducted in the same manner as used with 14.5 mm ammunition with the results indicating less damage to the aluminum armor because of the use of less powerful ammunition. Some of the 14.5 mm were defeated by shattering, not by tumbling.

Applicant believes that the general movement of the projectile is somewhat similar to that illustrated in FIG. 5 which illustrates a 0.50 caliber projectile 130 moving along an intended path 132. The projectile 130 first passes through the outer wall 28 of the housing **26*b* making a hole 134 therein and then engages and is deflected by the face 120 of the first expanded metal member 20*a* as indicated at 130*a*. The arcuate surfaces, sharp edges and flat surfaces disposed at acute angles relative to the face 120 caused the projectile to tumble. As the projectile 130 passes through the first layer of expanded metal as indicated at 130*b*, the projectile breaks fragments of the expanded metal to define a jagged opening (not shown) in the first member 20*a*. The forward end of the projectile 130 then engages the second expanded metal member 20*b* and is further deflected and tumbled somewhat as indicated at 130*c* and 130*d* forming a large jagged opening 136 therein. The wide arcuate surface of the projectile then engages the aluminum armor body 22 of the vehicle 24 and is stopped somewhat as indicated at 130*e* by the aluminum armor and then sometimes causes a bulge 138** before being stopped.

Although the specification has disclosed expanded metal members of a size and shape adapted to protect an object from 14.5 mm and 0.50 caliber projectiles, it will be understood that the expanded metal may be of larger (or smaller) sizes to reduce the lethality of larger projectiles to less than lethal force.

From the foregoing description it is apparent that the method, apparatus and article of manufacture of the present invention provides expanded metal armor for military vehicles or other objects which may be placed on existing vehicles or the like to upgrade its armor to reduce the lethality of the projectile to less than lethal force by causing the projectile to tumble in response to engaging the uneven faces of one or a plurality of expanded metal members so that the large arcuate surface of the projectile is turned and contacts the protected object with less than lethal force, or stops before contacting the protected object.

Although the best mode contemplated for carrying out the present invention has been herein shown and described, it will be apparent that modification and variation may be made without departing from what is regarded to be the subject matter of the invention.

What is claimed is:

1. An apparatus for protecting a military vehicle having an armored body against ballistic threats from a high speed bullet adapted to be propelled along a predetermined path externally of and toward the vehicle and having a small diameter pointed leading surface and a large diameter generally cylindrical side surface, the improvement which comprises:

means defining a plurality of layers of stand-up hardened steel expanded metal members having a plurality of interconnected out of phase sinuous sections with sharp upstanding edges and a plurality of curved surfaces;

means for mounting said layers of expanded metal members on the armored body of said vehicle in spaced relation from each other and from said body in position to be sequentially engaged by the leading end surface of the bullet as the bullet moves along said path toward said vehicle;

said sharp upstanding edges and said curved surfaces on a first hit expanded metal layer cooperating to define means for engaging the small pointed leading surface of the bullet for deflecting and tumbling the bullet from said path and allowing the bullet to pass through said first expanded metal layers; and said sharp upstanding edges and said curved surfaces on a second expanded metal layer cooperating to define means for further deflecting and tumbling the bullet from said path and causing the large side surface of the bullet to be stopped by said armored body with less than lethal force, each of said expanded metal members being formed from a steel plate having hardenability characteristics of AISI 4355 plate and are hardened to a Rockwell hardness of about RC 54.

2. An apparatus according to claim 1 wherein each of said plates has a thickness of about 1/4 inch prior to being expanded and after expanded has a thickness of about 1/2 inch.

3. An apparatus according to claim 2 wherein when said hardened steel expanded metal members are contacted by a 14.5 millimeter bullet weighing about 990 grains and moving at a velocity of between about 2800–3330 feet per second when contacting the first layer of expanded metal, and wherein the two spaced layers of expanded metal are penetrated by the bullet which tumbles sufficiently to engage the armored body of the vehicle with less than lethal force.

4. An apparatus according to claim 2 wherein when said hardened steel expanded metal members are contacted by a 0.50 caliber bullet weighing about 695 grains and moving at a velocity of between about 2930 to 2965 feet per second when contacting the first layer of expanded metal, and wherein the two spaced layers of expanded metal are penetrated by the bullet which tumbles sufficiently to engage the armored body of the vehicle with less than lethal force.

5. A method of protecting an object against ballistic threats from a high speed projectile adapted to be moved along a path externally of and toward the object and having a symmetrically pointed small leading end and a large diameter cylindrical side surface, said method comprising the steps of:

forming at least one hardened stand-up type expanded metal member which provides sharp cutting edges defined by planar surfaces and arcuate surfaces;

mounting at least one hardened stand-up expanded metal member in position to be engaged by the pointed leading end of said projectile, and deflecting the leading end of said projectile from said intended path in response to said projectile contacting said hardened upstanding edges and curved surfaces which lie in said path for reducing the velocity of and tumbling the projectile for causing said large diameter cylindrical side surface of the projectile to apply less than lethal force to the object, said expanded metal being formed from a steel plate having the hardenability characteristics of AISI 4355 steel which is ¼ inch thick prior to being formed into stand-up expanded metal, and additionally comprising the step of hardening the expanded metal to a Rockwell hardness of about RC 54.

6. A method according to claim 5 wherein when two spaced expanded metal members are mounted in the path of said projectile, and wherein said two expanded metal members are effective to render a projectile non-lethal to the object when the projectile is a 14.5 millimeter projectile traveling at a velocity of about 2800 to 3300 feet per second when first contacting one of said members and having a weight of about 990 grains.

7. A method according to claim 5 wherein two spaced expanded metal members are mounted in the path of movement of said projectile, and wherein said two expanded metal members are effective to render the projectile non-lethal to the object when the projectile is a 0.50 caliber projectile traveling at a velocity between about 2900–3100 feet per second when first contacting one of said members, and having a weight of about 695 grains.

8. An article of manufacture in the form of an integral armored member for neutralizing a moving projectile comprising:

a steel member;

a first plurality of hardened interconnected spaced sinuous sections included in said member and having longitudinally spaced first high points and longitudinally spaced first low points;

a second plurality of hardened interconnected spaced sinuous sections formed between said first sections with portions integral with said first sections and having longitudinally spaced second high points and longitudinally spaced second low points out-of-phase with said first high and low points;

said first high points and the adjacent second low points defining openings therebetween;

said first low points and said second high points defining openings therebetween; and said openings being defined by hardened sharp edges of planar surfaces that are at an acute angle relative to a face of said members which contacts all of said first high points of said first sinuous section, said steel member having a Rockwell hardness of about RC 54.

9. An article of manufacture according to claim 8 wherein said steel member is AISI 4355 steel.

10. An apparatus for protecting an object against ballistic threats from a high speed projectile traveling at an initial speed of at least 2943 feet per second and being at least 0.50 caliber in size, said projectile being adapted to be propelled along a path toward the object and having a small leading surface and an arcuate side surface, said apparatus comprising:

means defining a stand-up expanded metal member having a plurality of closely spaced sharp edges and a plurality of curved surfaces, and further having a thickness of at least 3/16th of an inch before being expanded and a Rockwell C hardness of at least 45 after being expanded;

means for mounting said expanded metal member in position to be engaged by the leading end surface of the projectile as the projectile moves along said path toward said object; and said sharp edges and curved surfaces defining means for deflecting the leading end surface of the projectile from said intended path in response to said projectile contacting said sharp edges and curved surfaces as the projectile passes through said expanded metal member for causing the wide arcuate surface of the projectile to apply less than lethal force to the object.

11. An apparatus for protecting a military vehicle having an armored body against ballistic threats from a military weapon which propels a projectile along a path toward the vehicle and having a small pointed leading surface and a wide arcuate surface, said apparatus comprising:

means defining a plurality of layers of stand-up expanded metal members each having a plurality of sharp upstanding edges and a plurality of curved surfaces, and further having a thickness of at least 3/16th of an inch before being expanded and a Rockwell C hardness of at least 45 after being expanded;

means for mounting said layers of expanded metal members on the armored body of said vehicle in spaced relation from each other and from said body in position to be sequentially engaged by the projectile as the projectile moves along said path toward said vehicle;

said sharp upstanding edges and said curved surfaces of a first expanded metal layer cooperating to define means for deflecting and tumbling the projectile from said path and allowing the projectile to pass through said first expanded metal layer; and said sharp upstanding edges and said curved surfaces on a second expanded metal layer cooperating to define means for further deflecting and tumbling the projectile from said path and allowing the projectile to be stopped with less than lethal force.

12. An armor member for neutralizing a high speed projectile fired from a military weapon comprising:

a stand-up steel member having a face, a thickness of at least 3/16th of an inch before expansion, and a Rockwell C hardness of at least 45 after being hardened;

a first plurality of spaced sinuous sections formed in said member and having longitudinally spaced first high points and longitudinally spaced first low points;

a second plurality of spaced sinuous sections formed between said first sections with portions integral with said first sections and having longitudinally spaced second high points and longitudinally spaced second low points out of phase with said first high and low points;

said first high points and the adjacent second low points defining openings therebetween;

said first low points and said second high points defining openings therebetween; and said openings being defined by sharp edges of planar surfaces that are at an acute angle relative to a face of said member which contacts all of said first high points of said first sinuous sections.

* * * * *